US007724224B2

(12) United States Patent
Kwon et al.

(10) Patent No.: US 7,724,224 B2
(45) Date of Patent: May 25, 2010

(54) DISPLAY DEVICE

(75) Inventors: Su-Hyun Kwon, Suwon-si (KR); Myeong-Su Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1344 days.

(21) Appl. No.: 11/064,075

(22) Filed: Feb. 23, 2005

(65) Prior Publication Data

US 2005/0195144 A1 Sep. 8, 2005

(30) Foreign Application Priority Data

Feb. 25, 2004 (KR) ..... 10-2004-0012739

(51) Int. Cl.
*G09G 3/36* (2006.01)

(52) U.S. Cl. ..... 345/89; 345/96

(58) Field of Classification Search ..... 345/89, 345/96, 98, 204, 581, 209
See application file for complete search history.

(56) References Cited

U.S. PATENT DOCUMENTS 6,020,869 A * 2/2000 Sasaki et al. ..... 345/89
6,028,588 A 2/2000 Yoon
6,353,435 B2 3/2002 Kudo et al.
2002/0118183 A1 8/2002 Inuzuka et al.
2002/0130881 A1 * 9/2002 Kudo et al. ..... 345/581
2003/0184508 A1 10/2003 Lee

FOREIGN PATENT DOCUMENTS

JP 2003-262848 9/2003
JP 2001-183625 10/2009

* cited by examiner

*Primary Examiner*—Amare Mengistu
*Assistant Examiner*—Yuk Chow
(74) *Attorney, Agent, or Firm*—F. Chau & Associates, LLC

(57) ABSTRACT

A display device includes: a display panel including pixels; a signal controller that stores FRC patterns including data elements having first or second value, selects one of the FRC data patterns based on input image data having a first bit number, and converts the input image data into output image data having a second bit number based on the selected FRC data pattern; and a data driver applying to the pixels data voltages corresponding to the output image data supplied from the signal controller. The data voltages have first or second polarity, and the number of the pixels supplied with data voltages that correspond to the output image data converted based on the first value and have the first polarity is equal to the number of the pixels supplied with data voltages that correspond to the output image data converted based on the first value and have the second polarity.

21 Claims, 5 Drawing Sheets

| LSB 2bits | Frame No. | | | |
|---|---|---|---|---|
| | 1 | 2 | 3 | 4 |
| 01 |  |  |  |  |
| 10 |  |  |  |  |
| 11 |  |  |  |  |

| LSB 2bits | Frame No. | | | |
|---|---|---|---|---|
| | 1 | 2 | 3 | 4 |
| 01 |  |  |  |  |
| 10 |  |  |  |  |
| 11 |  |  |  |  |

*FIG. 5*

| LSB 2bits | Frame No. 1 | 2 | 3 | 4 |
|---|---|---|---|---|
| 01 | | | | |
| 10 | | | | |
| 11 | | | | |

*FIG. 6*

| LSB 2bits | Frame No. 1 | 2 | 3 | 4 |
|---|---|---|---|---|
| 01 | | | | |
| 10 | | | | |
| 11 | | | | |

*FIG. 7*

| LSB 2bits | Frame No. 1 | 2 | 3 | 4 |
|---|---|---|---|---|
| 01 | | | | |
| 10 | | | | |
| 11 | | | | |

*FIG. 8*

| LSB 2bits | Frame No. 1 | 2 | 3 | 4 |
|---|---|---|---|---|
| 01 | | | | |
| 10 | | | | |
| 11 | | | | |

DISPLAY DEVICE

BACKGROUND OF THE INVENTION (a) Field of the Invention

The present invention relates to an apparatus and a method of driving a liquid crystal display.

(b) Description of Related Art

A flat panel display such as a liquid crystal display (LCD) and an organic light emitting display (OLED) includes a display panel, a plurality of drivers for driving the display panel, and a controller for controlling the drivers.

An LCD includes two panels having pixel electrodes and a common electrode and a liquid crystal (LC) layer with dielectric anisotropy, which is interposed between the two panels. The pixel electrodes are arranged in a matrix, connected to switching elements such as thin film transistors (TFTs), and supplied with data voltages through the switching elements. The common electrode covers entire surface of one of the two panels and is supplied with a common voltage. The pixel electrode, the common electrode, and the LC layer form a LC capacitor in circuital view, which is a basic element of a pixel along with the switching element connected thereto.

In the LCD, the two electrodes supplied with the voltages generate electric field in the LC layer, and the transmittance of light passing through the LC layer is adjusted by controlling the strength of the electric field, thereby obtaining desired images. In order to prevent image deterioration due to the unidirectional electric field, polarity of the data voltages with respect to the common voltage is reversed every frame, every row, or every dot.

The display device receives digital input image data for red, green, and blue colors from an external graphics source. A signal controller of the display device appropriately processes the input image data and supplies the processed image data to a data driver. The data driver converts the digital image data into analog data voltages and applies the data voltages to the pixels.

The bit number of the input image data from the graphics source may not be equal to that of the image data capable of being processed in the data driver. For example, a data driver capable of processing only 6-bit data is commonly used for reducing the manufacturing cost although the bit number of the input image data is eight.

In order to convert the 8-bit image data into the 6-bit image data capable of being processed in the data driver, it is proposed that frame rate control (FRC) should be applied for use in the display device.

FRC represents high-bit data as low-bit data and their temporal and spatial arrangements. For FRC, the signal controller modifies a high-bit input data in a frame for a pixel into a low-bit data depending on the position of the pixel and the serial number of the frame. A pattern containing the modification data as function of the position of the pixel and the serial number of the frame, which is stored in a memory such as a frame memory, is called FRC pattern.

Such FRC pattern is determined so that it may not generate stripes or flickering on the display device due to the difference in the data voltages or due to the polarity of the data voltages.

SUMMARY OF THE INVENTION

A display device is provided, which includes: a display panel including a plurality of pixels; a signal controller that stores a plurality of FRC patterns including data elements having first or second value, selects one of the FRC data patterns based on input image data having a first bit number, and converts the input image data into output image data having a second bit number smaller than the first bit number based on the selected FRC data pattern; and a data driver applying to the pixels data voltages corresponding to the output image data supplied from the signal controller, wherein the data voltages have first or second polarity, and the number of the pixels supplied with data voltages that correspond to the output image data converted based on the first value and have the first polarity is equal to the number of the pixels supplied with data voltages that correspond to the output image data converted based on the first value and have the second polarity.

The signal controller may include: a look-up table storing the FRC data patterns; and a data processor converting the input image data into the output image data based on the FRC data patterns stored into the look-up table.

Each FRC data pattern may have a 4×4 data matrix form and the difference between the first bit number and the second number may be equal to two.

Each of the input image data may include lower bit data and upper bit data and the selection of the FRC patterns may be based on the lower bit data of the input image data and a serial number of frames.

When the lower bit data has a value "00," the data processor may determine the upper bit data as the output image data.

According to an embodiment of the present invention, the FRC patterns for the lower bit data of the value "01" are different from each other, the FRC patterns for the lower bit data of the value "11" are different from each other, and at least two of the FRC patterns for the lower bit data of the value "10" are equivalent.

Four FRC patterns may be assigned to each value of the lower bit data. When the lower bit data has a value "01" or "11," two of the four FRC patterns are inverted to each other and the other two of the four FRC patterns are inverted to each other. When the lower bit data has a value "01," two of the data elements of each 4×2 data matrix may have the first value, and a distance between the two data elements having the first value in one of the 4×2 data matrices may be equal to a distance between the two data elements having the first value in the other of the 4×2 data matrices.

Each of the four FRC patterns may include a pair of 4×2 data matrices. When the lower bit data has a value "11," two of the data elements of each 4×2 data matrix may have the second value, and a distance between the two data elements having the second value in one of the 4×2 data matrices may be equal to a distance between the two data elements having the second value in the other of the 4×2 data matrices.

When the lower bit data has a value "01," two of the data elements of each 4×2 data matrix may have the first value, and a distance between the two data elements having the first value in one of the 4×2 data matrices may be different from a distance between the two data elements having the first value in the other of the 4×2 data matrices. When the lower bit data has a value "11," two of the data elements of each 4×2 data matrix have the second value, and a distance between the two data elements having the second value in one of the 4×2 data matrices may be different from a distance between the two data elements having the second value in the other of the 4×2 data matrices.

Each of the four FRC patterns may include four 2×2 data matrices. When the lower bit data may have a value "10," a first pair of the four 2×2 data matrices may be equivalent, and a second pair of the four 2×2 data matrices may be equivalent and inverted to the first pair.

The data elements in a row in each of the four 2×2 data matrices may have an equal value, and the data elements in different rows in each of the four 2×2 data matrices may have different values. The data elements in a column in each of the four 2×2 data matrices have an equal value, and the data elements in different columns in each of the four 2×2 data matrices have different values. The 2×2 data matrices adjacent to each other may be inverted to each other and the 2×2 data matrices in a diagonal may be equivalent. All elements of the 2×2 data matrices may be equal to each other.

In each of the 2×2 data matrices in at least one of the FRC patterns, the data elements in a diagonal may have the same value and adjacent data elements in each of the 2×2 data matrices in the at least one of the FRC patterns may have different values.

A display device is provided, which includes: a display panel including a plurality of pixels; a signal controller that stores a plurality of FRC patterns including data elements having first or second value, selects one of the FRC data patterns based on input image data having a first bit number, and converts the input image data into output image data having a second bit number smaller than the first bit number based on the selected FRC data pattern; and a data driver applying to the pixels data voltages corresponding to the output image data supplied from the signal controller. The difference between the first bit number and the second number is equal to two. Each of the input image data includes two-bit lower bit data and upper bit data. The selection of the FRC patterns is based on the lower bit data of the input image data and a serial number of frames. Each of the FRC patterns includes a pair of 4×2 data matrices. When the lower bit data has a value "01," two of the data elements of each 4×2 data matrix have the first value, and a distance between the two data elements having the first value in one of the 4×2 data matrices is equal to a distance between the two data elements having the first value in the other of the 4×2 data matrices. When the lower bit data has a value "11," two of the data elements of each 4×2 data matrix have the second value, and a distance between the two data elements having the second value in one of the 4×2 data matrices is equal to a distance between the two data elements having the second value in the other of the 4×2 data matrices.

When the lower bit data has a value "01," two of the data elements of each 4×2 data matrix may have the first value, and a distance between the two data elements having the first value in one of the 4×2 data matrices may be different from a distance between the two data elements having the first value in the other of the 4×2 data matrices. When the lower bit data has a value "11," two of the data elements of each 4×2 data matrix may have the second value, and a distance between the two data elements having the second value in one of the 4×2 data matrices may be different from a distance between the two data elements having the second value in the other of the 4×2 data matrices.

A display device is provided, which includes: a display panel including a plurality of pixels; a signal controller that stores a plurality of FRC patterns including data elements having first or second value, selects one of the FRC data patterns based on input image data having a first bit number, and converts the input image data into output image data having a second bit number smaller than the first bit number based on the selected FRC data pattern; and a data driver applying to the pixels data voltages corresponding to the output image data supplied from the signal controller. The difference between the first bit number and the second number is equal to two. Each of the input image data includes two-bit lower bit data and upper bit data. The selection of the FRC patterns is based on the lower bit data of the input image data and a serial number of frames. Each of the FRC patterns includes four 2×2 data matrices. The data elements in a row in each of the four 2×2 data matrices have an equal value, and the data elements in different rows in each of the four 2×2 data matrices have different values.

A display device is provided, which includes: a display panel including a plurality of pixels; a signal controller that stores a plurality of FRC patterns including data elements having first or second value, selects one of the FRC data patterns based on input image data having a first bit number, and converts the input image data into output image data having a second bit number smaller than the first bit number based on the selected FRC data pattern; and a data driver applying to the pixels data voltages corresponding to the output image data supplied from the signal controller. The difference between the first bit number and the second number is equal to two. Each of the input image data includes two-bit lower bit data and upper bit data. The selection of the FRC patterns is based on the lower bit data of the input image data and a serial number of frames. Each of the FRC patterns includes four 2×2 data matrices. The data elements in a column in each of the four 2×2 data matrices have an equal value and the data elements in different columns in each of the four 2×2 data matrices have different values.

BRIEF DESCRIPTION OF THE DRAWINGS

The present invention will become more apparent by describing embodiments thereof in detail with reference to the accompanying drawing in which:

FIGS. 3-8 are FRC data patterns according to embodiments of the preset invention.

DETAILED DESCRIPTION OF EMBODIMENTS

Figure 1:
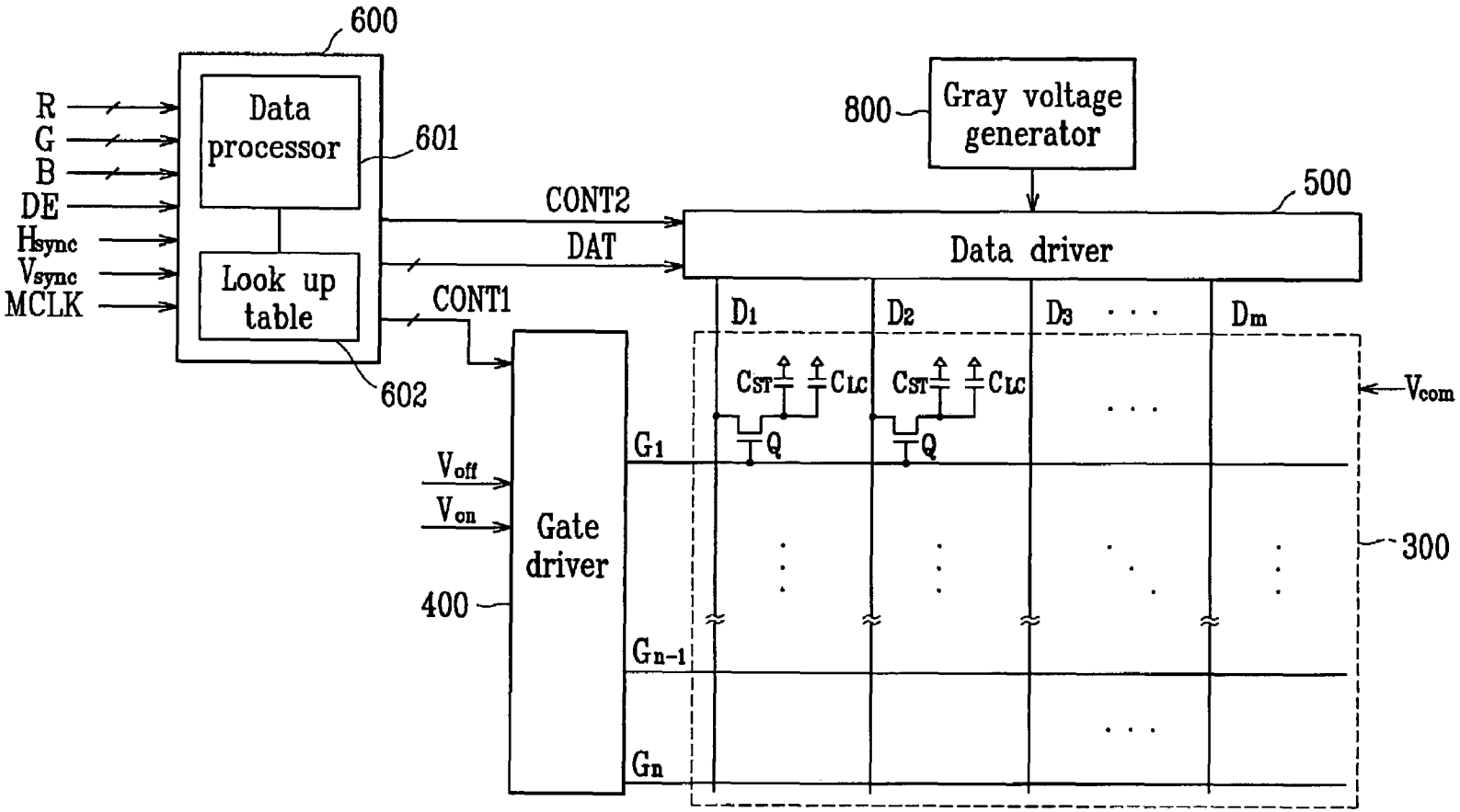
FIG. 1 is a block diagram of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, display devices according to embodiments of the present invention will be described with reference to the accompanying drawings.

Figure 2:
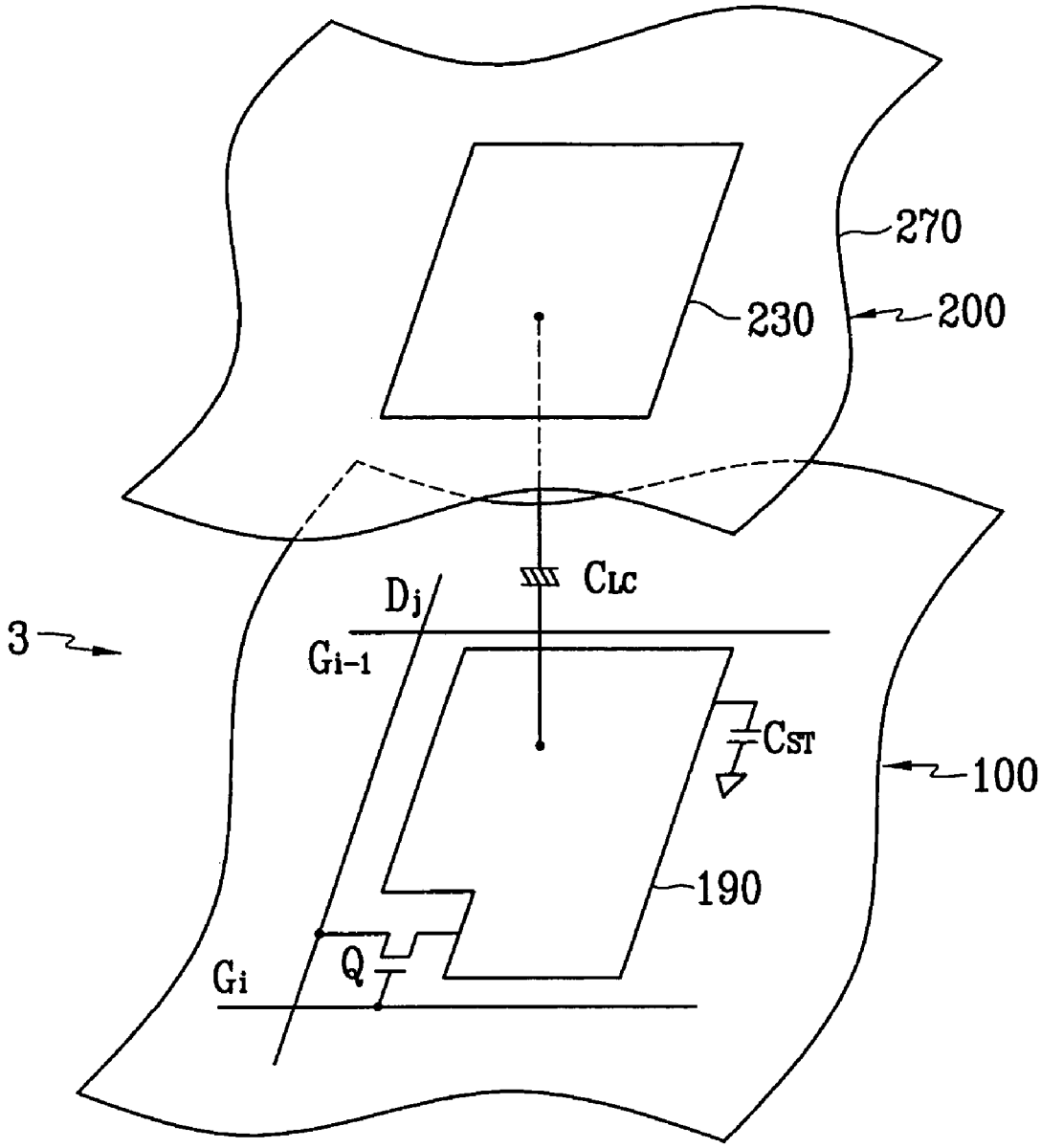
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment, which is an example of a display device, includes a LC panel assembly 300, a gate driver 400 and a data driver 500 that are connected to the panel assembly 300, a gray voltage generator connected to the data driver 500, and a signal controller 600 controlling the above elements.

Referring to FIG. 1, the panel assembly 300 includes a plurality of display signal lines $G_1$-$G_n$ and $D_1$-$D_m$ and a plurality of pixels connected thereto and arranged substantially in a matrix. In a structural view shown in FIG. 2, the panel assembly 300 includes lower and upper panels 100 and 200 and a LC layer 3 interposed therebetween.

The display signal lines $G_1$-$G_n$ and $D_1$-$D_m$ are disposed on the lower panel 100 and include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially in a row direction and substantially parallel to each other, while the data lines $D_1$-$D_m$ extend substantially in a column direction and substantially parallel to each other.

Each pixel includes a switching element Q connected to the signal lines $G_1$-$G_n$ and $D_1$-$D_m$, and a LC capacitor $C_{LC}$ and a storage capacitor $C_{ST}$ that are connected to the switching element Q. If unnecessary, the storage capacitor $C_{ST}$ may be omitted.

The switching element Q including a TFT is provided on the lower panel 100 and has three terminals: a control terminal connected to one of the gate lines $G_1$-$G_n$; an input terminal connected to one of the data lines $D_1$-$D_m$; and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as dielectric of the LC capacitor $C_{LC}$. The pixel electrode 190 is connected to the switching element Q, and the common electrode 270 is supplied with a common voltage Vcom and covers an entire surface of the upper panel 200. Unlike FIG. 2, the common electrode 270 may be provided on the lower panel 100, and at least one of the electrodes 190 and 270 may have a shape of bar or stripe.

The storage capacitor $C_{ST}$ is an auxiliary capacitor for the LC capacitor $C_{LC}$. The storage capacitor $C_{ST}$ includes the pixel electrode 190 and a separate signal line, which is provided on the lower panel 100, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, each pixel uniquely represents one of primary colors (i.e., spatial division) or each pixel sequentially represents the primary colors in turn (i.e., temporal division) such that spatial or temporal sum of the primary colors are recognized as a desired color. An example of a set of the primary colors includes red, green, and blue colors. FIG. 2 shows an example of the spatial division that each pixel includes a color filter 230 representing one of the primary colors in an area of the upper panel 200 facing the pixel electrode 190. Alternatively, the color filter 230 is provided on or under the pixel electrode 190 on the lower panel 100.

One or more polarizers (not shown) are attached to at least one of the panels 100 and 200.

Referring to FIG. 1 again, the gray voltage generator 800 generates two sets of a plurality of gray voltages related to the transmittance of the pixels. The gray voltages in one set have a positive polarity with respect to the common voltage Vcom, while those in the other set have a negative polarity with respect to the common voltage Vcom.

The gate driver 400 is connected to the gate lines $G_1$-$G_n$ of the panel assembly 300 and synthesizes the gate-on voltage Von and the gate-off voltage Voff from an external device to generate gate signals for application to the gate lines $G_1$-$G_n$.

The data driver 500 is connected to the data lines $D_1$-$D_m$ of the panel assembly 300 and applies data voltages, which are selected from the gray voltages supplied from the gray voltage generator 800, to the data lines $D_1$-$D_m$.

The drivers 400 and 500 may include at least one integrated circuit (IC) chip mounted on the panel assembly 300 or on a flexible printed circuit (FPC) film in a tape carrier package (TCP) type, which are attached to the LC panel assembly 300. Alternately, the drivers 400 and 500 may be integrated into the panel assembly 300 along with the display signal lines $G_1$-$G_n$ and $D_1$-$D_m$ and the TFT switching elements Q.

The signal controller 600 controls the gate driver 400 and the data driver 500 and it includes a data processor 601 and a look-up table 602. The look-up table 602 stores FRC data patterns.

Now, the operation of the LCD will be described in detail.

The signal controller 600 receives input image data R, G and B and input control signals controlling the display thereof such as a vertical synchronization signal Vsync, a horizontal synchronization signal Hsync, a main clock MCLK, and a data enable signal DE, from an external graphics controller (not shown). After generating gate control signals CONT1 and data control signals CONT2 and processing the image data R, G and B suitable for the operation of the panel assembly 300 on the basis of the input control signals and the input image data R, G and B, the signal controller 600 provides the gate control signals CONT1 for the gate driver 400, and the processed image data DAT and the data control signals CONT2 for the data driver 500.

The data processing of the signal controller 600 includes FRC using the FRC data patterns stored in the look-up table 602. FRC takes upper bits of the input image data and makes remaining lower bits to be represented as temporal and spatial arrangements of the taken upper bits, when the bit number of image data capable of being processed by the data driver 500 is smaller than that of the input image data R, G, and B. For example, when the bit number of the input image data R, G, and B is eight and the bit number of image data capable of being processed by the data driver 500 is six, the signal controller 600 may convert an 8-bit image data in a frame for a pixel into a 6-bit image data that has a value equal to or larger than by one upper six bits of the 8-bit image data and determined by lower two bits of the 8-bit image data, the position of the pixel, the serial number of the frame. FRC will be described later in detail.

The gate control signals CONT1 include a scanning start signal STV for instructing to start scanning and at least a clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing of start of data transmission for a group of pixels, a load signal LOAD for instructing to apply the data voltages to the data lines $D_1$-$D_m$, and a data clock signal HCLK. The data control signal CONT2 may further include an inversion signal RVS for reversing the polarity of the data voltages (with respect to the common voltage Vcom).

Responsive to the data control signals CONT2 from the signal controller 600, the data driver 500 receives a packet of the image data DAT for the group of pixels from the signal controller 600, converts the image data DAT into analog data voltages selected from the gray voltages supplied from the gray voltage generator 800, and applies the data voltages to the data lines $D_1$-$D_m$.

The gate driver 400 applies the gate-on voltage Von to the gate line $G_1$-$G_n$ in response to the gate control signals CONT1 from the signal controller 600, thereby turning on the switching elements Q connected thereto. The data voltages applied to the data lines $D_1$-$D_m$ are supplied to the pixels through the activated switching elements Q.

The difference between the data voltage and the common voltage Vcom is represented as a voltage across the LC capacitor $C_{LC}$, which is referred to as a pixel voltage. The LC molecules in the LC capacitor $C_{LC}$ have orientations depending on the magnitude of the pixel voltage, and the molecular orientations determine the polarization of light passing through the LC layer 3. The polarizer(s) converts the light polarization into the light transmittance.

By repeating this procedure by a unit of the horizontal period (which is denoted by "1H" and equal to one period of the horizontal synchronization signal Hsync and the data enable signal DE), all gate lines $G_1$-$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is referred to as "frame inversion"). The inversion control signal RVS may be also controlled such that the polarity of the data voltages flowing in a data line in one frame are reversed (for example, line inversion and dot inversion), or the polarity of the data voltages in one packet are reversed (for example, column inversion and dot inversion).

The FRC of the data processor 601 of the signal controller 600 according to embodiments of the present invention is now described in detail with reference to FIGS. 3-8 as well as FIG. 1.

FIGS. 3-8 are show sets of FRC data patterns according to embodiments of the preset invention.

One of the FRC data pattern sets shown in FIGS. 3-8 is stored in the look-up table 602 of the signal controller 600. Each of the FRC data patterns in a FRC data pattern set is determined by lower two bits of input image data and the serial number of frames. The FRC data patterns are given for four consecutive frames and three values "01," "10," and "11" of the lower two bits and thus the total number of the FRC data patterns in the FRC data pattern set is twelve. There is no FRC data pattern for the value "00" of the lower two bits.

Referring to FIGS. 3-8, each FRC data pattern is determined by lower two bits of input image data R, G and B and a serial number of a frame of the input image data R, G and B divided by four. The basic unit for a spatial arrangement of each FRC data pattern is a 4×4 data matrix including data elements and this means that the FRC data pattern is repeatedly applied to the pixels by a 4×4 pixel matrix. Each data element has a value of one or zero. In the figures, white blocks denote the data elements having the value of zero and hatched blocks denote the data elements having the value of one.

For a given input image data R, G and B for a pixel, the signal controller 600 selects one from the FRC data patterns based on the lower two bits of the input image data R, G and B and the frame number. The signal controller 600 reads the value of a data element of the selected FRC data pattern corresponding to the position of the pixel and determines an output image data to be supplied to the data driver 500 based on the read data element.

In detail, when the read data value is zero, the data processor 601 determines that an output gray is equal to the gray represented by the upper six bits of the input image data R, G and B. On the contrary, when the read data value is one, the data processor 601 determines that an output gray is obtained by adding one to the gray represented by the upper six bits of the input image data R, G and B. The signal controller 600 outputs a six-bit image data DAT representing the output gray to the data driver 500.

When the lower two bits of the input image data R, G and B is equal to "00", the data processor 601 immediately determines that an output gray is equal to the gray represented by the upper six bits of the input image data R, G and B without accessing the look-up table 602.

Now, the FRC data patterns shown in FIGS. 3-8 are described in detail.

When the lower 2-bit data has a value "01," twelve data elements, i.e., ¾ of total sixteen data elements in each FRC data pattern have the data value of one and the remaining four data elements have the data value of zero. When the lower 2-bit data has a value "10," eight data elements, i.e., ⅔ of the sixteen data elements have the data value zero and the remaining eight data elements have the data value "1." When the lower 2-bit data has a value "11," four data elements, i.e., ¼ of the sixteen data elements, have the data value of one and the remaining twelve data elements have the data value of zero. This rule is referred to as dithering, spatial FRC.

Focusing on a data element at a given position in each of four FRC data patterns given to each value of the lower two bits, the number of the data elements having the values of zero and one is determined by the values of the lower two bits. For example, when the lower 2-bit data has the value "01," the data element has the value of zero in three FRC data patterns and has the value of one in remaining one FRC data pattern. Similarly, when the lower 2-bit data has the value "10," the data element has the value of zero in two FRC data patterns and has the value of one in remaining two FRC data patterns. When the lower 2-bit data has the value "11," the data element has the value of zero in one FRC data pattern and has the value of one in remaining three FRC data patterns. This rule is referred to as temporal FRC.

On the other hand, all the data elements of a FRC data pattern that may be given to the lower bit value of "00" may have zero values and thus the FRC data patterns for the lower bit value of "00" need not be stored. Accordingly, although the total number of the FRC data patterns required for FRC of the data conversion from an eight-bit image data to a six-bit image data is sixteen theoretically, the look-up table 602 stores only twelve FRC data patterns for the data values of "01", "10," and "11."

Now, the features of the FRC data patterns shown in FIGS. 3-8 are described.

Among the twelve FRC data patterns shown in FIGS. 3-8, four FRC data patterns for the lower bit value of "01" are different from each other and four FRC data patterns for the lower bit value of "11" are also different from each other. For the lower bit value of "01," two of the four FRC data patterns are inverted to each other and the remaining two FRC data patterns are inverted to each other. Similarly, two of the four FRC data patterns for the lower bit value of "11" are inverted to each other and the remaining two FRC data patterns are inverted to each other.

On the other hand, at least two of four FRC data patterns for the lower bit value of "10" may be equivalent. For example, in each of the FRC data pattern sets shown in FIGS. 3-5, the FRC data patterns for first and third frames are equivalent and those for second and fourth frames are also equivalent. The FRC data patterns for first and second frames are equivalent and those for third and fourth frames are also equivalent in each of the data pattern sets shown in FIGS. 6 and 7.

In the meantime, each of the 4×4 data matrices of the FRC data patterns includes two 4×2 data matrices and the spatial and temporal FRC rules are also applied to each of the four 4×2 data matrices.

Figure 3:
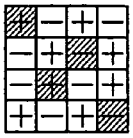
Figure 3:
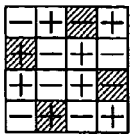
Figure 3:
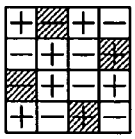
Figure 3:
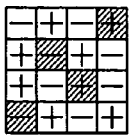
Figure 3:
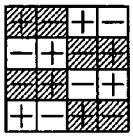
Figure 3:
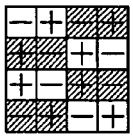
Figure 3:
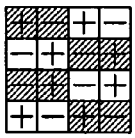
Figure 3:
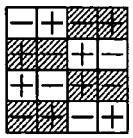
Figure 3:
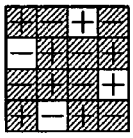
Figure 3:
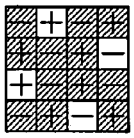
Figure 3:
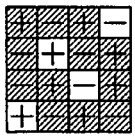
Figure 3:
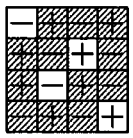
Figure 4:
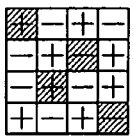
Figure 4:
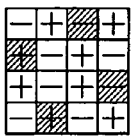
Figure 4:
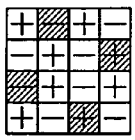
Figure 4:
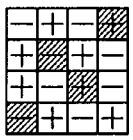
Figure 4:
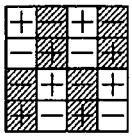
Figure 4:
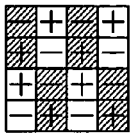
Figure 4:
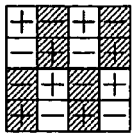
Figure 4:
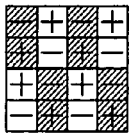
Figure 4:
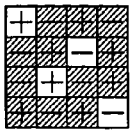
Figure 4:
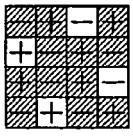
Figure 4:
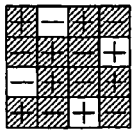
Figure 4:
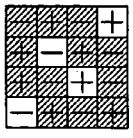

Referring to FIGS. 3 and 4, in each of the FRC data patterns for the lower bit value of "01," the distance between the data elements having the data value of one in a 4×2 data matrix is equal to that in the other 4×2 data matrix. On the contrary, the distance between the data elements having the data value of zero in a 4×2 data matrix is equal to that in the other 4×2 data matrix, in each of the FRC data patterns for the lower bit value of "11."

Referring to FIGS. 5-8, on the other hand, the distance between the data elements having the data value of one in a 4×2 data matrix is different from that in the other 4×2 data matrix, in each of the FRC data patterns for the lower bit value of "01." The distance between the data elements having the data value of zero in a 4×2 data matrix is different from that in the other 4×2 data matrix, in each of the FRC data patterns for the lower bit value of "11."

Each of the 4×4 data matrices of the FRC data patterns includes four 2×2 data matrices and the spatial and temporal FRC rules determine the arrangement of each of the four 2×2 data matrices.

Referring to FIGS. 3-8, four 2×2 data matrices of each FRC data pattern for the lower bit values of "01" and "11" are different from one another.

When the lower bit value is "10," relations between four 2×2 data matrices of each FRC data pattern is described.

Except for FIG. 8, a pair of 2×2 data matrices among the four 2×2 data matrices are equivalent and the other pair of 2×2 data matrices are also equivalent and inverted to the former pair. Referring to FIGS. 3, 6 and 7, two 2×2 data matrices arranged in a column direction are equivalent and two 2×2 data matrices arranged in a row column direction are inverted to each other. On the contrary, FIG. 4 shows that two 2×2 data matrices arranged in a column direction are inverted to each other and two 2×2 data matrices arranged in a row column direction are equivalent. Referring to FIG. 5, adjacent 2×2 data matrices are inverted and 2×2 data matrices in a diagonal is equivalent.

Referring to FIG. 8, a pair of 2×2 data matrices are inverted to each other and the other pair of 2×2 data matrices are also inverted to each other.

The data elements of each 2×2 data matrix for the lower bit value of "10" are described.

Referring to FIGS. 3, 6 and 7, the data elements in a row have an equal vale and those in different rows have different values. Referring to FIG. 4, the data elements in a column have an equal vale and those in different columns have different values. Referring to FIG. 5, all the data elements in each 2×2 data matrix have the same value.

Referring to FIG. 8, for first and fourth frames, the data elements in a diagonal in each 2×2 data matrix have an equal value and adjacent data elements have different values. For second and third frames, the data elements in a row have in each 2×2 data matrix an equal vale and those in different rows have different values.

The FRC data patterns shown in FIGS. 3-8 are merely examples according to embodiments of the present invention. The FRC data patterns may have configurations depending on the difference in the bit number between the input image data R, G and B and the data that can be processed by the data driver 500, the characteristics of the display device, and so on.

In the meantime, reference signs "+" and "−" shown in FIGS. 3-8 denote the polarity of the pixel voltages for pixels in a 4×4 pixel matrix, which corresponds to the 4×4 data matrix of the FRC data pattern, under 2×1 dot inversion and frame inversion. It is assumed that the input image data R, G and B for all pixels are the same. Among the pixels to be assigned with an equal gray in each frame, the number of the pixels having positive polarity (+) is the same as that having negative polarity (−). For a given gray, it is noted that the pixel voltage having positive polarity is slightly different from that having negative polarity. Accordingly, the average luminance can be kept constant to improve image quality when the number of the pixels having pixel voltages of positive polarity is equal to the number of the pixels having pixel voltages of negative polarity.

It is apparent that the inversion type can be varied other than 4×4.

The configurations and the sequence of the FRC data patterns shown in FIGS. 3-8 can be varied row by row, column by column, or frame by frame.

As described above, the FRC data patterns for respective frames have 4×4 data matrix form and thus various FRC data patterns can be realized. In addition, the difference in the pixel voltages of the pixels given to the same gray is reduced to decrease the deterioration of the image quality caused by the luminance difference.

The above-described FRC patterns can be adaptable to any type of display device.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A display device comprising:

a display panel including a plurality of pixels;

a signal controller that stores a plurality of FRC patterns including data elements having first or second value, selects one of the FRC data patterns based on input image data having a first bit number, and converts the input image data into output image data having a second bit number smaller than the first bit number based on the selected FRC data pattern; and a data driver applying to the pixels data voltages corresponding to the output image data supplied from the signal controller, wherein the data voltages have first or second polarity, and the number of the pixels supplied with data voltages that correspond to the output image data converted based on the first value and have the first polarity is equal to the number of the pixels supplied with data voltages that correspond to the output image data converted based on the first value and have the second polarity in each data FRC pattern, and wherein each of the input image data includes two-bit lower bit data and upper bit data and the selection of the FRC patterns is based on the lower bit data of the input image data and a serial number of frames.

2. The display device of claim 1, wherein the signal controller comprises:

a look-up table storing the FRC data patterns; and a data processor converting the input image data into the output image data based on the FRC data patterns stored into the look-up table.

3. The display device of claim 2, wherein each FRC data pattern has a 4×4 data matrix form.

4. The display device of claim 3, wherein the difference between the first bit number and the second number is equal to two.

5. The display device of clam 2, wherein when the lower bit data has a value "00," the data processor determines the upper bit data as the output image data.

6. The display device of claim 1, wherein the FRC patterns for the lower bit data of the value "01" are different from each other, the FRC patterns for the lower bit data of the value "11" are different from each other, and at least two of the FRC patterns for the lower bit data of the value "10" are equivalent.

7. The display device of claim 6, wherein four FRC patterns are assigned to each value of the lower bit data, when the lower bit data has a value "01" or "11,"two of the four FRC patterns are inverted to each other and the other two of the four FRC patterns are inverted to each other.

8. The display device of claim 1 wherein each of the FRC patterns includes a pair of 4×2 data matrices, and when the lower bit data has a value "01," two of the data elements of each 4×2 data matrix have the first value, and a distance between the two data elements having the first value in one of the 4×2 data matrices is equal to a distance between the two data elements having the first value in the other of the 4×2 data matrices.

9. The display device of claim 8, wherein each of the FRC patterns includes a pair of 4×2 data matrices, and when the lower bit data has a value "11," two of the data elements of each 4×2 data matrix have the second value, and a distance between the two data elements having the second value in one of the 4×2 data matrices is equal to a distance between the two data elements having the second value in the other of the 4×2 data matrices.

10. The display device of claim 1, wherein each of the FRC patterns includes a pair of 4×2 data matrices, and when the lower bit data has a value "01," two of the data elements of each 4×2 data matrix have the first value, and a distance between the two data elements having the first value in one of the 4×2 data matrices is different from a distance between the two data elements having the first value in the other of the 4×2 data matrices.

11. The display device of claim 10, wherein each of the FRC patterns includes a pair of 4×2 data matrices, and when the lower bit data has a value "11," two of the data elements of each 4×2 data matrix have the second value, and a distance between the two data elements having the second value in one of the 4×2 data matrices is different from a distance between the two data elements having the second value in the other of the 4×2 data matrices.

12. The display device of claim 1, wherein each of the FRC patterns includes four 2×2 data matrices, and when the lower bit data has a value "10," a first pair of the four 2×2 data matrices are equivalent, and a second pair of the four 2×2 data matrices are equivalent and inverted to the first pair.

13. The display device of claim 12, wherein the data elements in a row in each of the four 2×2 data matrices have an equal value, and the data elements in different rows in each of the four 2×2 data matrices have different values.

14. The display device of claim 12, wherein the data elements in a column in each of the four 2×2 data matrices have an equal value, and the data elements in different columns in each of the four 2×2 data matrices have different values.

15. The display device of claim 12, wherein the 2×2 data matrices adjacent to each other are inverted to each other and the 2×2 data matrices in a diagonal are equivalent.

16. The display device of claim 15, wherein all elements of the 2×2 data matrices are equal to each other.

17. The display device of claim 15, wherein the data elements in a diagonal in each of the 2×2 data matrices in at least one of the FRC patterns have the same value and adjacent data elements in each of the 2×2 data matrices in the at least one of the FRC patterns have different values.

18. A display device comprising:

a display panel including a plurality of pixels;

a signal controller that stores a plurality of FRC patterns including data elements having first or second value, selects one of the FRC data patterns based on input image data having a first bit number, and converts the input image data into output image data having a second bit number smaller than the first bit number based on the selected FRC data pattern; and a data driver applying to the pixels data voltages corresponding to the output image data supplied from the signal controller, wherein the difference between the first bit number and the second number is equal to two, each of the input image data includes two-bit lower bit data and upper bit data and the selection of the FRC patterns is based on the lower bit data of the input image data and a serial number of frames, each of the FRC patterns includes a pair of 4×2 data matrices, and when the lower bit data has a value "01," two of the data elements of each 4×2 data matrix have the first value, and a distance between the two data elements having the first value in one of the 4×2 data matrices is equal to a distance between the two data elements having the first value in the other of the 4×2 data matrices, and when the lower bit data has a value "11," two of the data elements of each 4×2 data matrix have the second value, and a distance between the two data elements having the second value in one of the 4×2 data matrices is equal to a distance between the two data elements having the second value in the other of the 4×2 data matrices.

19. The display device of claim 18, wherein when the lower bit data has a value "01," two of the data elements of each 4×2 data matrix have the first value, and a distance between the two data elements having the first value in one of the 4×2 data matrices is different from a distance between the two data elements having the first value in the other of the 4×2 data matrices, when the lower bit data has a value "11," two of the data elements of each 4×2 data matrix have the second value, and a distance between the two data elements having the second value in one of the 4×2 data matrices is different from a distance between the two data elements having the second value in the other of the 4×2 data matrices.

20. A display device comprising:

a display panel including a plurality of pixels;

a signal controller that stores a plurality of FRC patterns including data elements having first or second value, selects one of the FRC data patterns based on input image data having a first bit number, and converts the input image data into output image data having a second bit number smaller than the first bit number based on the selected FRC data pattern; and a data driver applying to the pixels data voltages corresponding to the output image data supplied from the signal controller, wherein the difference between the first bit number and the second number is equal to two, each of the input image data includes two-bit lower bit data and upper bit data and the selection of the FRC patterns is based on the lower bit data of the input image data and a serial number of frames, each of the FRC patterns includes four 2×2 data matrices, and the data elements in a row in each of the four 2×2 data matrices have an equal value, and the data elements in different rows in each of the four 2×2 data matrices have different values.

21. A display device comprising:

a display panel including a plurality of pixels;

a signal controller that stores a plurality of FRC patterns including data elements having first or second value, selects one of the FRC data patterns based on input image data having a first bit number, and converts the input image data into output image data having a second bit number smaller than the first bit number based on the selected FRC data pattern; and a data driver applying to the pixels data voltages corresponding to the output image data supplied from the signal controller, wherein the difference between the first bit number and the second number is equal to two, each of the input image data includes two-bit lower bit data and upper bit data and the selection of the FRC patterns is based on the lower bit data of the input image data and a serial number of frames, each of the FRC patterns includes four 2×2 data matrices, the data elements in a column in each of the four 2×2 data matrices have an equal value, and the data elements in different columns in each of the four 2×2 data matrices have different values.

* * * * *